US012269086B2

(12) United States Patent
Poggipolini

(10) Patent No.: US 12,269,086 B2
(45) Date of Patent: Apr. 8, 2025

(54) METHOD AND PLANT FOR THE FAST MANUFACTURING OF FASTENERS

(71) Applicant: POGGIPOLINI S.P.A., San Lazzaro di Savena (IT)

(72) Inventor: Michele Poggipolini, San Lazzaro di Savena (IT)

(73) Assignee: POGGIPOLINI S.P.A., San Lazzaro di Savena (IT)

( * ) Notice: Subject to any disclaimer, the term of this patent is extended or adjusted under 35 U.S.C. 154(b) by 316 days.

(21) Appl. No.: 17/767,634

(22) PCT Filed: Oct. 10, 2019

(86) PCT No.: PCT/IB2019/058660
§ 371 (c)(1),
(2) Date: Apr. 8, 2022

(87) PCT Pub. No.: WO2021/069961
PCT Pub. Date: Apr. 15, 2021

(65) Prior Publication Data

US 2023/0330739 A1 Oct. 19, 2023

(30) Foreign Application Priority Data

Oct. 9, 2019 (IT) ..... 102019000018347

(51) Int. Cl.
*B21K 1/56* (2006.01)
*B21K 27/04* (2006.01)
*B21K 29/00* (2006.01)

(52) U.S. Cl.
CPC ..... *B21K 1/56* (2013.01); *B21K 27/04* (2013.01); *B21K 29/00* (2013.01)

(58) Field of Classification Search
CPC . B21K 1/44; B21K 1/56; B21K 27/04; B21K 29/00
(Continued)

(56) References Cited

U.S. PATENT DOCUMENTS 11,285,526 B2 * 3/2022 Erhard ..... B21K 1/56

FOREIGN PATENT DOCUMENTS

EP 2543453 A1 * 9/2013
JP H10-249475 A * 9/1998
(Continued)

OTHER PUBLICATIONS

Wen-Hai Liu, 'Development and Application of Titanium Alloy Aerospace Fasteners', https://www.fastener-world.com/data/pdf_download/FW_186_E_236.pdf, p. 238 (Year: 2021).*
(Continued)

*Primary Examiner* — Jared O Brown
(74) *Attorney, Agent, or Firm* — Leason Ellis LLP

(57) ABSTRACT

A method and a plant for manufacturing fasteners, in particular screws, along an automated production line; the method comprising the following steps: feeding the raw material made of titanium; heating the raw material to a predefined temperature; cutting one or more pieces of a predefined length, in succession, from the heated raw material; deforming plastically each piece by means of one or more finishing stations, so as to obtain a fastener; heating, during the deforming step, the material that passes through each workstation to a predefined temperature; wherein the material manipulated along the production line during the feeding, heating, and deforming steps is automatically transported along the production line.

16 Claims, 5 Drawing Sheets

(58) Field of Classification Search
USPC ..... 470/8, 9, 10, 11, 14
See application file for complete search history.

(56) References Cited

FOREIGN PATENT DOCUMENTS

| | | | | |
|---|---|---|---|---|
| JP | 3144520 | U | * | 9/2008 |
| KR | 10-0628030 | B1 | * | 9/2006 |
| WO | 201900114929 | A1 | | 6/2019 |

OTHER PUBLICATIONS

Saroj Kumar Sahu, 'An overview on the effect of heat-treatment and cooling rates on Ni-based superalloys', https://www.sciencedirect.com/science/article/pii/S2214785321050057, Jul. 22, 2021 (Year: 2021).*

Queen City Forging, 'Cold, Warm and Hot Forging: What's the Difference', https://www.qcforge.com/forging-knowledge/forging-benefits/hot-forging/, (Year: 2024).*

International Search Report and Written Opinion in PCT Application No. PCT/IB2019/058660, mailed Jul. 3, 2020.

* cited by examiner

METHOD AND PLANT FOR THE FAST MANUFACTURING OF FASTENERS

CROSS-REFERENCE TO RELATED APPLICATIONS

This patent application is a U.S. National Phase Application under 35 U.S.C. § 371 of International Patent Application No. PCT/IB2019/058660, filed on Oct. 10, 2019, which claims priority from Italian patent application no. 102019000018347 filed on Oct. 9, 2019, all of which are incorporated by reference, as if expressly set forth in their respective entireties herein.

TECHNICAL FIELD

This patent application for an invention concerns a method and a plant for the fast manufacture of fasteners.

BACKGROUND ART

The use of fasteners, in particular screws, to connect two or more mechanical components together is known.

Fasteners, such as screws, are subject to high mechanical stresses during use and must have a high mechanical (and often thermal) resistance, so as to ensure the proper operation, over time, of the mechanical components to which they are applied.

Fasteners, in particular screws, are used for a large number of different applications. Fasteners, in particular screws, are often installed in positions that are subject to high vibrations, for example, at a cylinder head of a combustion engine, or on aeronautical or aerospace vehicles.

In general, a fastener comprises a shank that is the connecting/holding element; depending on the type of fastener, the shank may have a head or may cooperate with other components such as: nuts, washers, rings, or the like. The fastener is preferably configured to clamp mechanical components subject to high dynamic stresses, i.e. vibrations, and/or thermal ones.

In particular, this invention refers to high performance fasteners, i.e. fasteners made of materials that are lighter than others but the mechanical properties of which are equal, such as yield stress and maximum tensile strength.

For example, high-performance fasteners can be made of generally coded materials such as: stainless steel (17-4PH, 15-5PH, 13-8PH), carbon steel (AISI304, AISI4340), special steel (AERMET100, MARAGING 300, INCONEL), or titanium (TIT.6Al4V).

More specifically, this invention refers to fasteners, in particular screws, that are made of titanium (more precisely Ti6Al4V) or of special steels, such as INCONEL, and that are configured to comply with specific reference standards for high strength fasteners. For example, the fasteners according to this invention are advantageously configured to comply with one or more of the following reference standards:

- ISO 9152D1998 "Aerospace-Bolts, with MJ threads, in titanium alloys, strength class 1100 MPa-Procurement specification",
- SAE AS 7460A "Bolts and Screws, Titanium Alloy, 6.0Al-4.0V, Procurement Specification for";
- BS A 101D1969+A3D2012 "Specification for general requirements for titanium bolts".

It should be noted that the above standards are included by way of example only and are not exhaustive. For example, the international regulations for the aeronautical sector AMS, or those of each manufacturer, are also be mentioned.

In fact, companies such as BOEING, BOMBARDIER, and AIRBUS have their own technical specifications to be met.

These types of high strength titanium fasteners are generally used in the automotive or aerospace sectors due to their potential for reducing weight. For example, a screw of the M12 type that is 140 mm long and made of titanium, in particular Ti6Al4V, has a weight of 85 g, a density of 4.43 g/cm$^3$, a yield stress of 980 MPa, and a maximum tensile strength of 1050 MPa. In comparison, an M12 fastener that is 140 mm long and made of steel, in particular 37Cr4, weighs 155 g, has a density of 7.76 g/cm$^3$, a yield stress of 1080 MPa, and a maximum tensile strength of 1150 MPa.

An example of a high-performance fastener is a flat-headed screw, generally known as a pin, which is widely used in the aerospace sector.

Methods for manufacturing fasteners made of titanium, or of titanium alloys, are already known. However, these known manufacturing methods require several hours of machining and many staff and machining centres, often requiring the transport of material during machining from one machining centre to another. In some cases the material is even transported from one plant to another during the manufacturing process, and sometimes semi-finished products are even transported from one country to another, with considerable transport and labour costs. In addition, known methods produce a lot of machining waste, which has to be disposed of.

For example, EP2543453 describes a known method and plant for manufacturing titanium screws by means of a warm forging process. The method described in EP2543453 is a method that requires, disadvantageously, the material to be heat treated for several hours (as described for example in paragraphs [0025] and [0147]) and the creation of a surface finish (generally by lathe machine), so as to remove a layer of oxide that forms on the surface of the fastener during heat treatment. In addition, the process described in EP2543453 requires that the material be moved between different machining centres.

Titanium fasteners are, therefore, generally more expensive compared to equivalent fasteners made of other materials, e.g. common steels.

Expenditure is estimated to be €13 to €20 for an equivalent titanium fastener compared to €1 to €3 for a steel fastener.

For this reason, titanium fasteners are currently only used for a few types of vehicles, for example: in the aerospace sector; for drones; for racing cars or motorbikes, in particular in F1; or for supercars.

However, it should be noted that a production vehicle (i.e. a car sold on a large scale) is estimated to have about 2000 fasteners. Therefore, reducing the weight of the fasteners of a production vehicle would have a significant impact on reducing its overall weight and, consequently, in reducing its emissions. In fact, reducing the weight of cars is one of the best and most certain ways of reducing emissions. It is estimated that a 100 kg reduction in weight corresponds to a fuel saving of about 0.35 L/100 km, and to a reduction in emissions of 9 g CO2/km.

Therefore, companies in the automotive sector would certainly be interested in being able to use titanium fasteners for production vehicles as well.

The purpose of this invention is to provide a method and a plant for quickly manufacturing fasteners made of titanium that overcome the drawbacks described above.

Subject-Matter of the Invention

The purpose of this invention is to provide a method and a plant that will reduce the manufacturing costs of titanium fasteners and thus allow their large-scale distribution.

The purpose of this invention is to provide a method and a plant for manufacturing titanium fasteners that are highly automated, that obtain a finished product in a short time, and that reduce machining waste.

According to this invention, a method as recited in the appended claims is provided.

According to this invention, a plant as recited in the appended claims is provided.

BRIEF DESCRIPTION OF THE DRAWINGS

The invention will now be described with reference to the appended drawings, showing non-limiting embodiments thereof, wherein.

PREFERRED EMBODIMENT OF THE INVENTION

Figure 1:
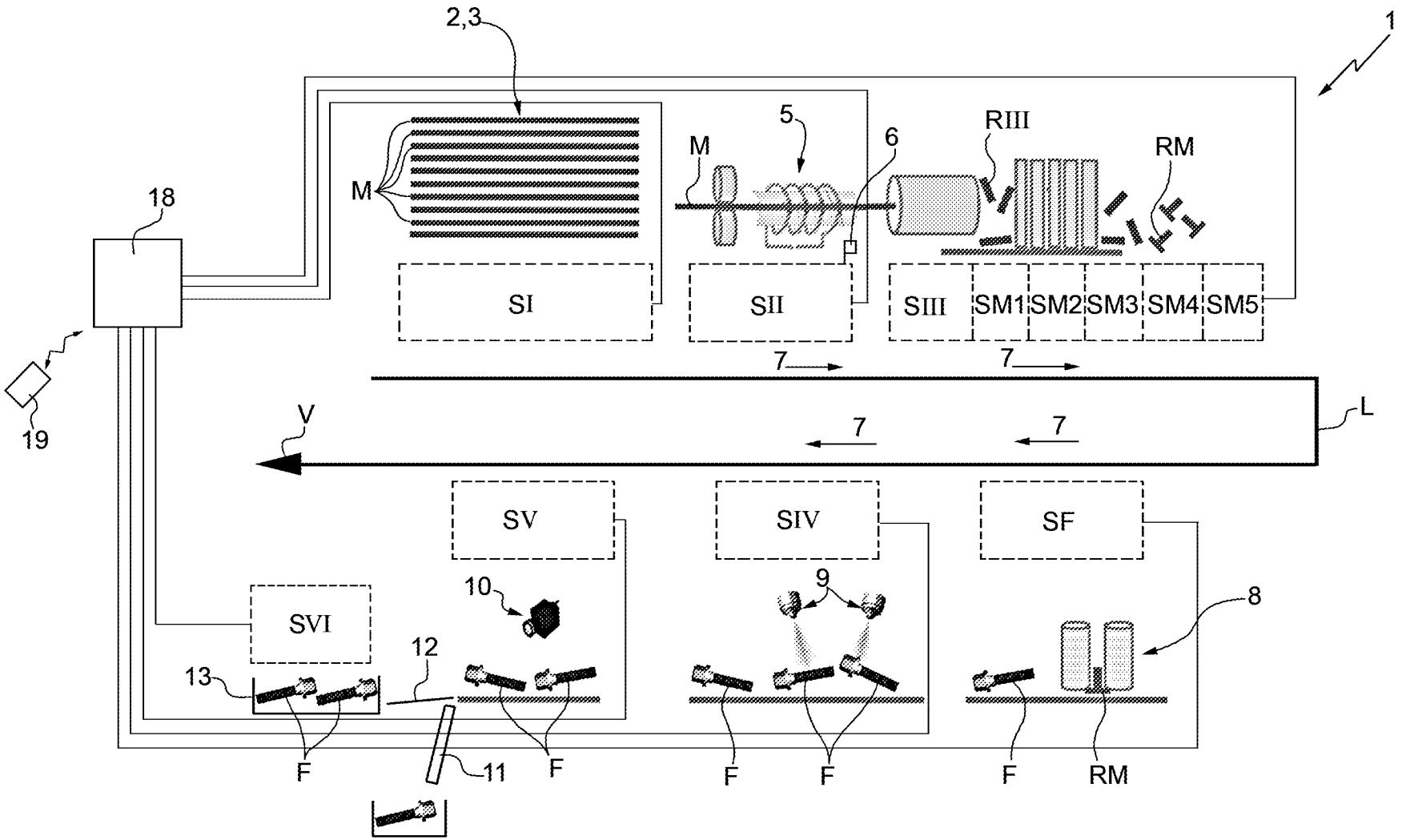
FIG. 1 schematically shows the manufacturing steps that are carried out along a plant according to this invention.

FIG. 1 shows as a whole a block diagram of the fast manufacturing method for titanium fasteners F according to this invention.

It should be pointed out that, in this discussion, the expression (used for brevity) "titanium" means a fastener F made of a material with high strength and low density. The fastener, for example, is made of titanium or of a titanium alloy. Alternatively, the fastener may be made of one of the following materials: stainless steel (17-4PH, 15-5PH, 13-8PH), carbon steel (AISI 304, AISI4340), or special steel (AERMET100, MARAGING 300, INCONEL). A titanium fastener F is preferably made of Ti6Al4V or INCONEL.

"Fastener F" means an element configured to connect and secure two or more mechanical components together. A fastener F is advantageously configured to be subjected to high mechanical stresses during use. In other words, a fastener F has high mechanical and thermal resistance, so as to ensure the proper operation, over time, of the mechanical components to which it is applied.

More specifically, a fastener F according to this invention is a screw or an element equivalent to a screw.

Typically, a fastener F comprises a shank 60 that is the connecting/holding element (depending on the type of fastener); the shank 60 may have a head 61; the shank 60 may cooperate with other components such as: nuts, washers, rings, or the like (not shown). The fastener F is preferably configured to clamp mechanical components subject to high dynamic stresses, i.e. vibrations, and/or thermal ones.

Fasteners F, in particular screws, are used for a large number of different applications. Fasteners F, in particular screws, are often installed in positions that are subject to high vibrations: for example, at a cylinder head of a combustion engine, or, in the aeronautical sector, for applications in aerostructures such as engines and landing gear.

According to this invention, the fastener F is, advantageously, a screw with a flat head 61 for aerospace applications, generally also known as a PIN.

Figure 5:
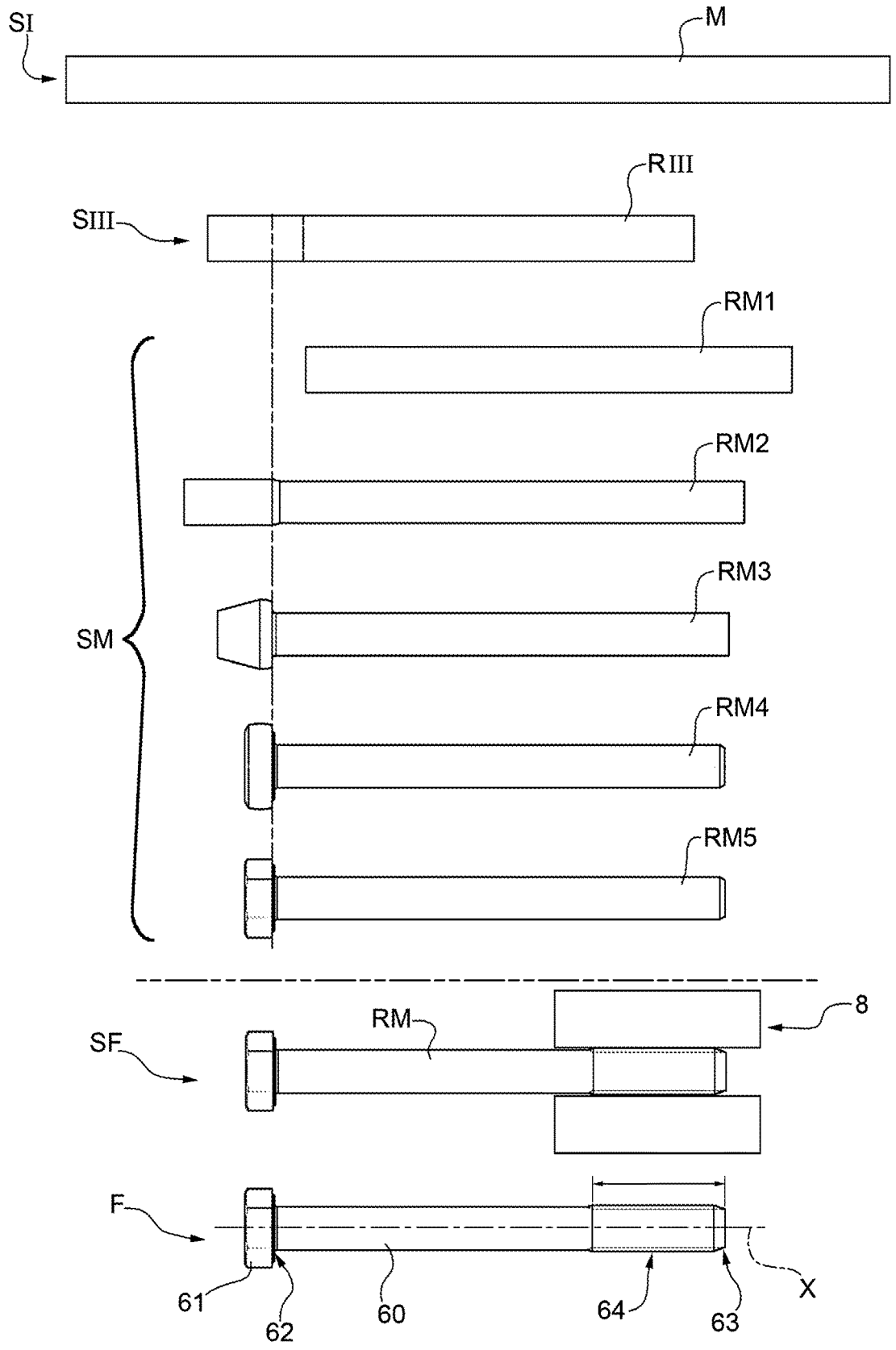
FIG. 5 shows the different manufacturing steps of a fastener according to this invention.

According to the example shown in FIG. 5, the fastener F is a screw and comprises a shank 60 and a head 61. The shank 60 is an axial symmetrical cylindrical body having a longitudinal axis X, a head end 62 (adjacent to the head 61 of the screw), and a foot end 63 (opposite end to the head end 62).

The head 61 of the screw overhangs from the head end 62.

The shank 60 has a thread 64. According to the example shown, the shank 60 has a thread 64 that starts from the foot end 63 and extends for a length 11 along the shank 60.

It should be pointed out that the fastener F, i.e. the screw, shown in FIG. 5 is for example only and is not exhaustive. In fact, a fastener F according to this invention may have different geometries and/or sizes that differ with respect to those represented. In addition, a fastener F according to this invention could comprise a threaded shank 60 alone in order to produce, for example, a stud in combination with other external components, such as nuts or the like. In other words, according to this invention, the fastener F could be without the head 61, or it could have a head 61 with proportions and shapes that differ with respect to those shown.

In addition, a fastener F could have a threaded shank 60 that is different to the one shown, for example, in terms of the number and type of threads, or in terms of the proportions and shape of the shank 60 (for example, the shank 60 could have projecting parts at intermediate positions).

According to a variant not shown, the method and the plant according to this invention allow single components of a fastener F, such as nuts, to be manufactured as well.

The method and the plant 1 according to this invention advantageously allow for the fast and automated production of any type of titanium fastener F, as will be shown more clearly below.

A fastener F according to this invention may advantageously have a shank 60 with a diameter between 4 and 60 mm and a total shank length between 10 and 320 mm.

In FIG. 1, the number 1 indicates, as a whole, a plant 1 according to this invention that is configured to automatically and quickly manufacture any type of titanium fastener F.

As will be shown more clearly below, a plant 1 according to this invention advantageously comprises a plurality of work stations S located in a series along a production line L that are configured to receive, at the inlet, the raw material M to be machined, in particular in cylindrical form, and to supply, at the outlet, fasteners F that are already packaged.

It should be noted that the generic term "material" is used below to refer to the raw material M, to any semi-finished product R, and to any fastener F that is advanced along the production line L.

The transport of material along the production line L is, advantageously, completely automated, thus requiring fewer people to be employed in the manufacturing step.

According to the example shown in FIG. 1, the plant 1 comprises a feeding station SI, at which a feeding system 2 of raw material M is located.

Figure 2:
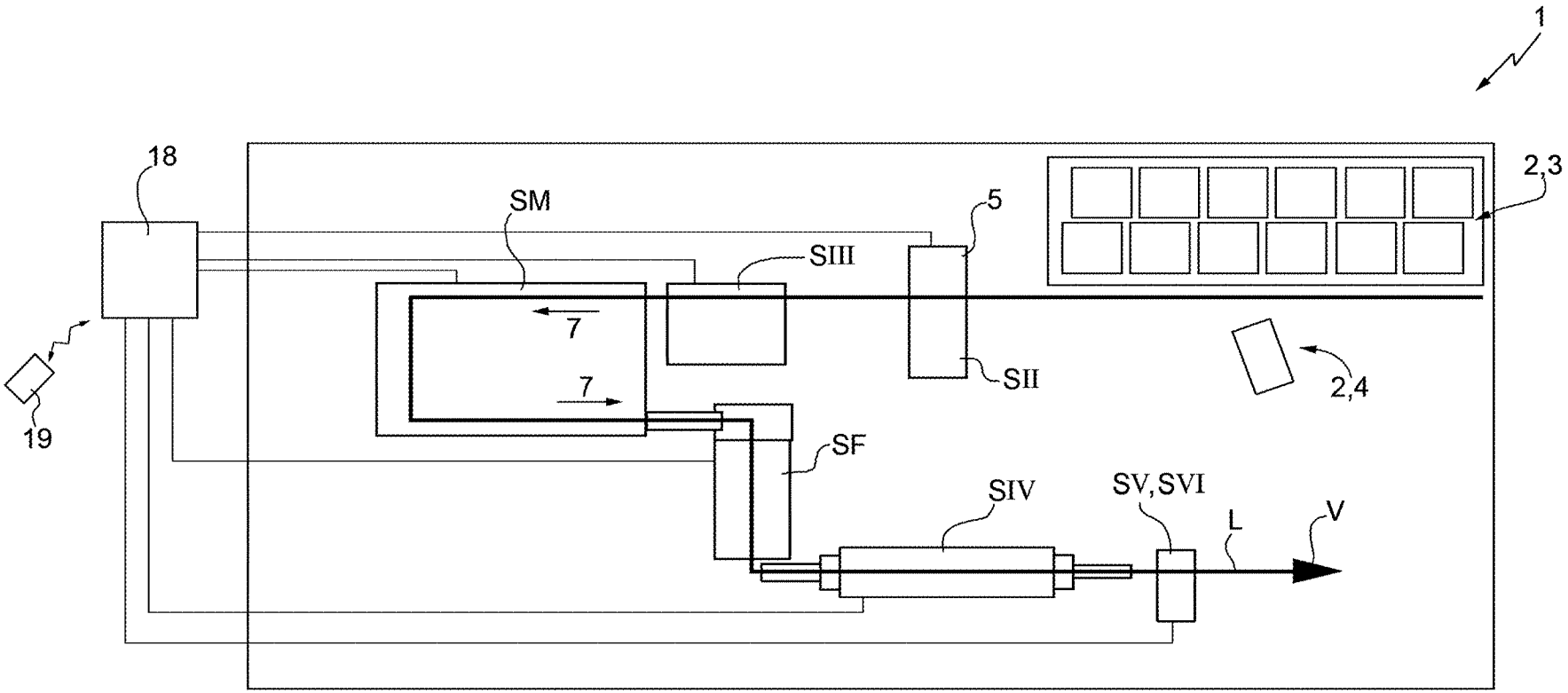
FIG. 2 schematically shows the plan of a plant according to this invention.
Figure 3:
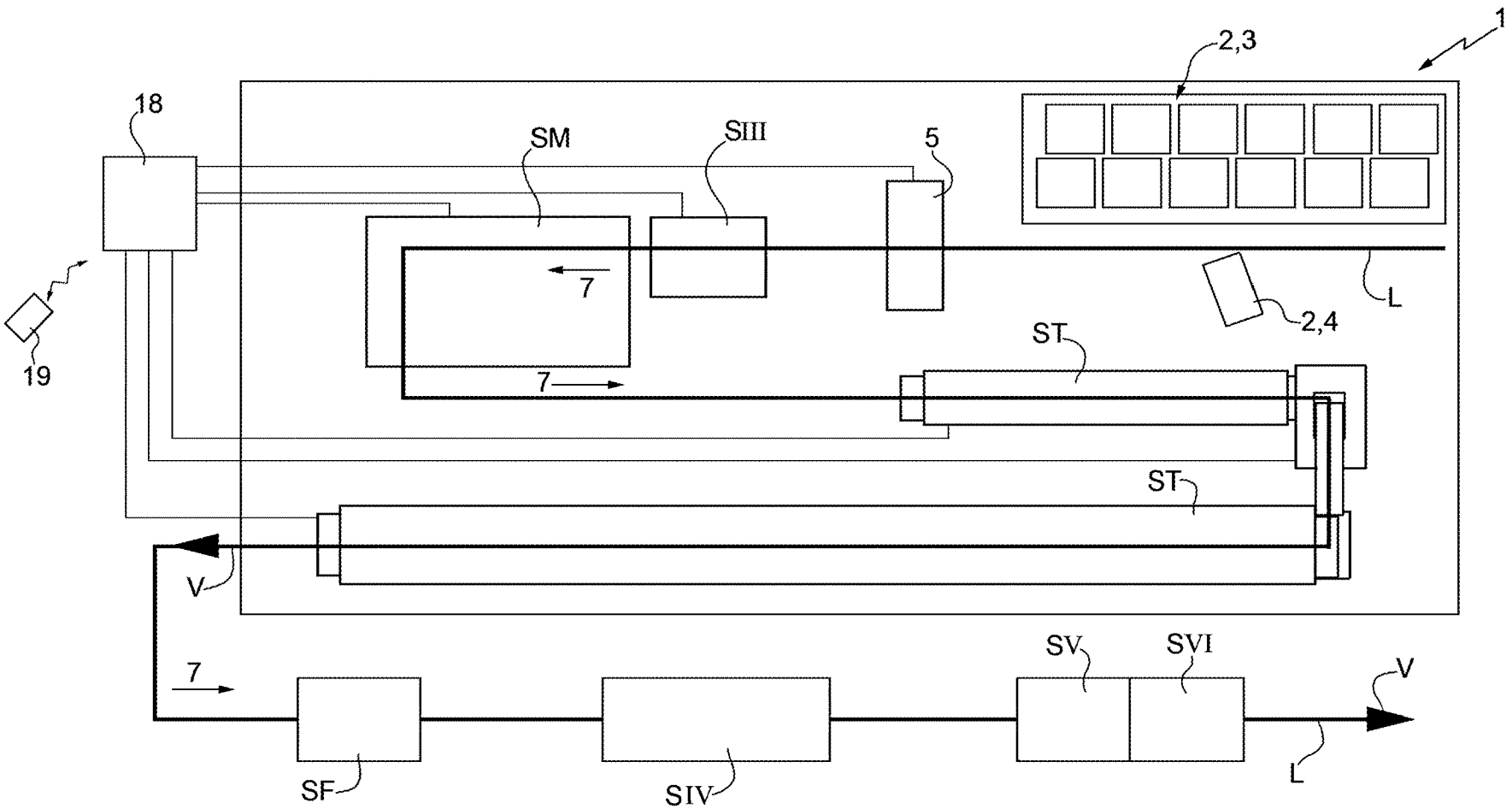
FIG. 3 is similar to FIG. 2 and shows a variant of a plant according to this invention.

According to the example shown in FIGS. 1 to 3, the plant 1 also comprises, in succession and according to the forward direction v of the material along the production line L:

a heating station SII;

a cutting station SIII;

one or more intermediate finishing stations SM;

a threading station SF;

a cleaning station SIV;

a quality control station SV; and a packaging station SVI.

What is shown in FIGS. 1 to 3 is only shown by way of example; it should be noted, in particular, that a plant 1 may comprise a different combination of the workstations S described above, in terms of number, type, and layout.

For example, according to a variant not shown, the production line may have a Y-shape; in other words, it may have two branches that join in a single final section. In this case, for example, the slower plastic deformation operations can be doubled across two essentially parallel lines and then joined in a final shared section where the faster workstations S are located. For example, the intermediate finishing stations SM could be slower compared to the threading station SF. In this case, the intermediate finishing stations would be located on the two parallel branches, while the final, shared section would have the threading station SF and, if necessary, the following optional stations for: cleaning SIV, quality control SV, and packaging SVI.

For example, in the examples shown, there are five intermediate finishing stations SM, but without losing generality, the intermediate finishing stations SM can be different in number, for example, there can be six or more, depending on the number of plastic deformation steps that are wanted, as will be shown more clearly below.

The plant 1 comprises a plurality of automatically operated die/punch systems (schematically shown), each of which is configured to plastically deform the material, according to predefined geometries, and to obtain a respective semi-finished product R.

Each die/punch system is located at a respective workstation S. In particular, the plant 1 comprises a die/punch system located at the cutting station SIII and a die/punch system for each intermediate finishing station SM.

One or more of the workstations S described above can be produced on board a single machine. For example, the heating station SII, the cutting station SIII, and the intermediate finishing stations SM may advantageously, but not necessarily, be produced on board a single machine tool.

According to a variant not shown, the cleaning station SIV and the quality control station SV are optional, i.e. one and/or the other may not be present along the production line L.

According to a variant not shown, the transport of the fasteners F along the production line L to the cleaning station SIV and/or to the quality control station SV may occur manually or semi-automatically.

According to the example shown in FIG. 1, the feeding system 2 is configured to feed a raw material M to the intermediate finishing stations SM.

The raw material M is, advantageously, cylindrical in shape and is a hard material, i.e. a material with high strength. The raw material M has, for example, a maximum tensile strength of 1100 MPa.

This is different to known methods, where the raw material M is soft, generally referred to as "SOFT", with a maximum tensile strength of about 900 MPa. Generally, the raw material M is covered with a layer of lubricating material (not shown). This lubricating material may already be applied to the stored raw material M, or the plant 1 can have a coating station (not shown) for raw material M placed between the feeding station SI and the heating station SII.

According to the example shown in FIGS. 1 to 3, the raw material M is fed in the form of bars.

In the example shown in FIGS. 1 to 3, the feeding system 2 comprises a storage unit 3 and an automated manipulator 4, e.g. a self-guiding system, generally known as an AGV, for titanium bars. The manipulator 4 is configured to take the titanium bars from the storage unit 3 and to feed them one at a time to the heating station SII.

The raw material M is subjected to a sequence of machining operations as it passes through the intermediate finishing stations SM. In particular, each intermediate finishing station is configured to plastically deform the material in a predefined way, in order to obtain a respective semi-finished product R.

The heating station SII advantageously comprises heating means 5 configured to heat the raw material M until it reaches a predefined temperature. The heating means 5 are, advantageously, induction means; in this way, the raw metallic material M is directly heated and not the environment surrounding the raw material M itself. In this way, heating costs are reduced and efficiency is increased.

The heating station SII advantageously comprises sensors 6 that are configured to determine the temperature reached by the raw material M.

The sensors 6 advantageously comprise, for example, a pyrometer for remotely detecting the temperature reached by the raw material M.

In the same way as above, each intermediate finishing station SM advantageously comprises heating means 5 configured to heat the material up to the desired temperature. The heating means 5 are, advantageously, of the induction type for directly heating the metallic material.

Each intermediate finishing station SM advantageously comprises sensors 6 for detecting the temperature reached by the material of the respective semi-finished product R.

The raw material M in the heating station SII is preferably heated to a predefined temperature. It should be noted that the temperature reached during this step is such as to favour the subsequent plastic deformation steps. It should be noted that the temperature reached in the heating station SII is not such as to allow heat treatment; in particular, the temperature reached in the heating station II is not such as to allow the formation of a surface layer of oxide on the raw material M.

In particular, at the cutting station SIII, the respective die/punch system is configured to cut the hot raw material M (i.e. heated up to a predetermined temperature value) so as to separate a starting piece RIII with a predefined length. Advantageously, therefore, the cutting station SIII is configured to obtain, in use, pieces RIII of a predefined length from the raw material M. Advantageously, the cutting station SIII comprises a die/punch system that is configured to continuously cut and feed each piece RIII to the successive intermediate finishing station SM. In this way, there are, advantageously, no interruptions at the cutting station SIII, speeding up the manufacturing method. A system that allows you to push a piece RIII to the successive intermediate finishing station SM, while it cuts the raw material M to produce a subsequent piece RIII, is, advantageously, provided at the cutting system SIII.

The number of intermediate finishing stations SM, and therefore the number of respective total plastic deformation steps of the semi-finished products, for obtaining the final product, depends on the complexity of the fastener F to be obtained.

The plant 1 may comprise more intermediate finishing stations SM (and, consequently, respective plastic deformation steps) than are required to obtain the fastener F. In this case, in use, one or more intermediate finishing stations SM may be deactivated so that the semi-finished product R can pass through without machining, as will be shown more clearly below.

In this case, advantageously, the type of final fastener F that can be obtained through the same plant 1 varies depending on the finishing stations that are activated at the passage of the semi-finished product R.

Advantageously, the die-punch systems of each intermediate finishing station SM and of the cutting station SII are interchangeable. In this case, advantageously, the type of fastener F that can be produced from the same plant 1 may vary depending on the type of die/punch system (generally also known as punch block) that happens to be installed in the respective intermediate finishing stations SM.

Advantageously, according to the above, it follows that with the same plant 1 it is possible to obtain a plurality of different fasteners F without having to stop production or modify the production line L. In fact, depending on the finishing stations that are activated/deactivated, and/or on the type of die/punch systems that are installed at the intermediate finishing stations SM, the type of fastener F that can be obtained changes.

According to a variant not shown, each intermediate finishing station SM can be formed by a respective hot forging machine, generally known as a printing machine.

Advantageously, the plant 1 comprises an automatic transport system 7 that is configured to automatically advance the material (i.e. the raw material, each semi-finished product R and the fastener) along the production line L. The automatic transport system 7 is shown schematically in the figures by the arrows.

At the outlet of the intermediate finishing stations SM, a finished semi-finished product RM is obtained that is ready for the production of one or more threads 64, without the need for intermediate machining (in the production methods known as machining operations and which involve, for example, machining on a lathe).

As shown in FIG. 1, the plant 1 also comprises, at the threading station SF, a threading unit 8 that is located downstream of the intermediate finishing stations SM and is configured to produce each thread 64 on the finished semi-finished product RM.

The threading unit 8 comprises opposing thread chasers that work in a known way, which is schematically shown, for the production of each thread 64. The thread chaser threading unit 8 is in particular suitable for producing standard threads and special external threads. According to a variant not shown, the threading unit 8 is of a different type and is configured to produce both internal threads and special threads.

The threading unit 8 advantageously comprises heating means 5 that are configured to keep the finished semi-finished product RM at a predefined temperature during the threading step. The heating means 5 of the threading unit 8 are advantageously of the induction type. The threading unit 8 is then configured to obtain the final fastener F.

As will be shown more clearly below, the threading unit 8 may, advantageously, be selectively activated/deactivated. In this way, it is possible to obtain a smooth fastener F at the outlet of the plant 1, which essentially corresponds geometrically to the finished semi-finished product R at the outlet of the threading unit 8, i.e. threaded, depending on the project requirements.

The plant 1 also comprises, at the cleaning station SIV, washing means 9 configured to remove the lubricant or resin that is applied to the beginning raw material M.

According to a variant not shown, the plant does not have a cleaning station SIV, as this station is optional.

The plant 1 also comprises optical and/or mechanical detection means 10 at the quality control station SV; these are configured to detect, for each fastener F, the size and/or geometric features of the fastener F itself, such as compliance with predefined tolerances.

For example, the quality control station SV can comprise both optical scanning systems and mechanical control systems so as to precisely and easily determine information relating to the geometries and sizes of each F fastener.

The quality control station SV comprises, in turn, a reject system 11 for fasteners F that do not comply with predefined requirements.

The plant 1 also comprises release means 12, such as a chute, at the packaging station SVI, configured to place each fastener F inside a respective container (often cardboard packaging).

According to the variant shown in FIG. 3, the plant 1 also comprises a heat treatment station along the production line L that is placed between the intermediate finishing stations SM and the threading station SF. The heat treatment station ST is configured to carry out the necessary treatments for certain types of fasteners F, for example for aerospace applications. For example, the plant 1 comprises an open furnace 14 at the heat treatment station ST. It should be noted that, as in the examples shown in FIGS. 1 to 3, the plant 1 may not have a heat treatment station ST, as this station is optional and its presence depends on the type of final fasteners F to be manufactured.

Figure 4:
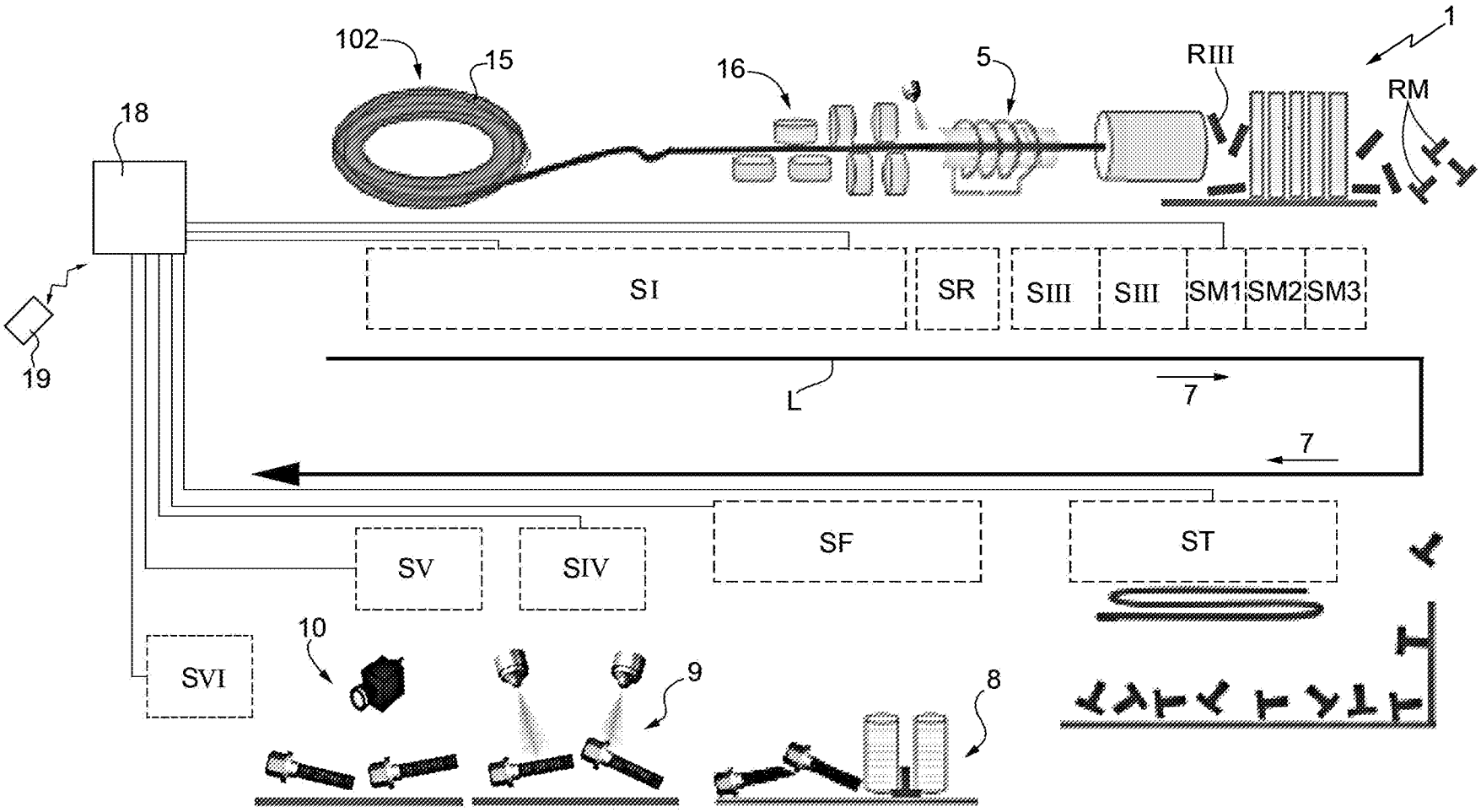
FIG. 4 is similar to FIG. 1 and shows an additional variant of a plant according to this invention.

According to the variant shown in FIG. 4, the feeding system 102 is different from the one shown and described above. In particular, in this case, the feeding system 102 comprises a coil 15 for feeding a wire (the raw material M) made of metallic material. The feeding system 102 also comprises a wire straightener 16. In the same way as described above, the raw material M in the form of a wire is fed to the heating station SII and then to the cutting station SIII. The production line L is therefore similar to the one described above. It should be noted that in FIG. 4 the elements in common with the plant 1 described above are considered as being comprised, though they are not repeated, for the sake of brevity.

The plant 1 according to this invention may alternatively comprise any feeding system 2, 102 of the type described above.

The possibility of providing one of the two feeding systems 2, 102 of the type described above allows the manufacturing method described above to be carried out irrespective of the supply type of the raw material M, i.e. irrespective of the way in which the suppliers are able to supply the raw material M. This advantageously makes it possible to cooperate with a plurality of different suppliers of the beginning raw material M.

The feeding system 2 or 102 may, advantageously but optionally, comprise, according to the example shown in FIG. 4, a coating station SR at which the raw material M is coated by means of coating material, for example by means of a bath system or by means of continuous chemical deposition. In this way, the plant 1 can be fed with an untreated raw material M (not having a coating), thus reducing the costs of supply, as the raw material M has undergone less machining by the supplier (it does not have a coating). In addition, the provision of a coating station SR along the production line L reduces production errors due to incomplete or incorrect coating of the raw material M. In fact, providing the already coated raw material M may be disadvantageous in that, during the storage period, the coating may be damaged or partially removed, with a greater probability of manufacturing waste occurring in these areas during manufacturing.

If the feeding system is of the 102 type, as shown in FIG. 4, the coating station may be provided near the straightening station, so that the straightening and coating steps occur almost simultaneously, reducing machining times.

The plant 1 advantageously comprises a control system 18 that is connected to each of the workstations S described above and is configured to collect data from the entire production line L of the plant 1. In particular, the control system 18 exchanges data with: the feeding system 2 or 102, the heating station SII, the cutting station SIII, each intermediate finishing station SM, the heat treatment station ST (if present), the threading station SF, the cleaning station SIV, the quality control station SV, and the packaging station SV.

In more detail, it should be observed that the workstations S described above can be integrated with respective machines, having sensors configured to detect certain parameters such as: the speed at which material passes, the material's operating temperature at each workstation S, the work speed of each workstation S, and the like. Each machine is advantageously equipped with a dedicated data collection system (commercially called POWER MES-Manufacturing Execution Systems).

The control system 18 is advantageously connected to each dedicated data collection system; in other words, it is what is commercially also called the SUPER POWER MES.

The control system 18 is configured to store and analyse data collected from the production line L. The control system 18 advantageously comprises data management units of the PLM (Product Lifecycle Management) type and a data management unit of the ERP (Enterprise Resource Planning) type. The PLM and ERP units are advantageously integrated with each other. In addition, the control system 18 comprises a user interface 19, with which input and output data can be exchanged with a user, such as an operator.

The user interface 19 can advantageously comprise a Digital Twin data management unit that exchanges data with the control system 18. In this way, a remote user can advantageously acquire a plurality of information by means of the user interface 19, such as: simulation of future productions, determination of preventive maintenance, manage the timing of supplies and the management of the plant 1, even remotely. In fact, the user interface 19 and/or the control system 18 can, advantageously, also be positioned in a remote location (even several kilometres away) with respect to the position of the plant 1; in this way, it is possible to provide remote assistance to the entire plant 1.

The control system 18 and the user interface 19 allow, advantageously, the management of plants 1 situated in different locations in the world from a single control centre, where highly specialised technicians are employed. In this way, thanks to the remote management, it is not necessary to have personnel with high technical skills employed locally for each plant 1. This allows, therefore, a reduction in management costs and indirect costs, essentially making each plant 1 autonomous.

The user interface 19 is, advantageously, an application (generally also known as an app) or a platform that is accessible by means of a smartphone, tablet and/or computer or the like.

The control system 18 is advantageously configured to control the operation of each workstation S. For example, the control system 18 is configured to selectively activate or deactivate one or more intermediate finishing station SM. In this way, it is possible to control, even remotely, the type of fastener F to be produced.

Advantageously, the control system 18 is configured to regulate the working temperature at each workstation S. In this way, depending on the type of raw material M and on the size of the raw material M or of the semi-finished product R, you can set the appropriate temperature suitable for obtaining the best final result.

The control system 18 is advantageously configured to identify and reject any non-compliant fasteners F that are detected at the quality control station SV. In particular, the control system 18 is configured to store and process data relating to any errors detected, so that such data can be used for diagnostics of the entire production line L and can detect any malfunctions at one or more workstation S.

The following describes a fast method for manufacturing a titanium fastener F according to this invention.

In use, the raw material M is arranged. According to the example shown in FIGS. 1 to 3, the raw material M is made up of bars, which are stacked in the storage unit 3. According to the example shown in FIG. 4, the raw material M is a coil 15, which is unwound by a straightening system.

The raw material M is then automatically fed to the heating station SII. According to the example shown in FIGS. 1 to 3, the bars are moved by an automatic manipulator 4. According to the example shown in FIG. 4, the raw material M is unwound from the coil 15.

The raw material M is, advantageously, a cylindrical body (a bar or a wire) made of titanium. The raw material M may already be coated with a surface layer, e.g. it may already be coated with a lubricant, or it may be coated as it advances along the plant 1.

At the heating station SII, the raw material is heated by the heating means 5. The raw material M is then further advanced along the plant 1, once a predefined temperature is reached.

The raw material M passes from the heating station SII to the cutting station SIII, where the raw material M is cut, i.e. separated, so as to obtain a single piece of material RIII.

Subsequently, each piece RIII advances along the production line L under the action of the transport system 7. In particular, each piece RIII passes through each intermediate finishing station SM in succession. At one or more intermediate finishing station SM, the piece RIII is plastically deformed. The number of intermediate finishing stations SM operated as the pieces RIII pass through is a function of the complexity of the geometry and the degree of precision required by the final F fastener. The control system 18 is, advantageously, capable of activating/deactivating in real time one or more intermediate finishing stations SM.

In this way, with the same plant 1, and without needing to replace, for example, the die-punch systems (i.e. the punch block) of each work station S, it is possible to produce a plurality of fasteners F that are different in terms of their geometry and/or size. Therefore, the plant 1 of the type described above advantageously allows you to obtain, by means of the same plant 1 and as it is running, i.e. without the need to stop the plant for a format change, batches of fasteners F that are different in terms of their geometry and/or size. (If necessary, it is possible to temporarily interrupt the plant for the set-up, in particular, for the replacement of punch blocks, which can be prepared in masked time; in this way, the pause of the plant for the set-up is considerably reduced).

According to a variant not shown, the pieces RIII can be heated at each intermediate finishing station SM. In this case, the temperature of each piece RIII can be selectively modified depending on the intermediate finishing station SM, i.e. depending on the type of plastic deformation it has to undergo in a given intermediate finishing station SM. In this way, maximum method efficiency and the highest final quality of the fastener F is guaranteed.

Advantageously, if necessary, thanks to the variant shown in FIG. 3, it is possible to perform heat treatments on the final piece RIII coming out of the intermediate finishing stations SM.

Advantageously, the threading step of the piece RIII is carried out at the threading station SF, so that one or more threads are produced on each final piece RIII. It should be noted that, advantageously, the threading process is also hot. That is, during the threading step, the final piece RIII is heated by heating means 5, in particular, by induction means.

At the cleaning station SIV, each fastener F is washed so as to remove the initial coating.

At the quality control station, the correct execution of each fastener F is checked and fasteners F that do not comply with pre-set requirements (e.g. do not have a compliant geometry or size) are discarded.

Advantageously, at the outlet of the quality control station SV, each fastener F is placed inside a respective packaging (cardboard box).

It follows from the above that the method for manufacturing a fastener F is, advantageously, fully automated. This significantly reduces the number of operators involved in the manufacturing process of the fasteners F (a reduction from 9 to 2 operators is estimated, compared to standard production methods).

Advantageously, the fact of feeding raw material M with a maximum tensile strength of 1100 MPa, i.e. which has already been subjected to treatments to obtain this value, allows relatively low temperatures to be maintained during the various machining steps and, therefore, the heat treatments that, according to the known production methods must be carried out between forging and mechanical machining, to be eliminated. In this way, no layers of surface oxides are formed (which does happen with known methods) and it is not necessary to carry out mechanical machining, often lathe machining, to remove the layer of oxide that forms during heat treatment and/or to obtain the final desired shape of the fastener F from the semi-finished products.

Advantageously, the manufacturing method and plant 1 of the type described above allow the time and, consequently, the cost of manufacturing fasteners F to be significantly reduced, which means, therefore, a substantial reduction in the costs of manufacturing fasteners F.

Advantageously, the method and plant 1 of the type described above allow, approximately, at least 100 fasteners F to be manufactured per minute (the speed of the entire manufacturing method depends on the complexity of the geometry of the fastener F to be manufactured and on the number of workstations S arranged along the production line L, and on whether the production line has parallel branches for the simultaneous execution of some steps).

The plant 1 described above advantageously allows finished fasteners F to be obtained, in particular, fasteners that are perfectly compliant in terms of size/geometry/surface finish with the project data, without the need to subject the pieces to additional mechanical machining (which is generally expensive and requires the intervention of personnel). In other words, the method and the plant 1 of the type described above allow a finished fastener F to be obtained, without the use of auxiliary work machines located outside the production line L. This significantly reduces manufacturing times and costs and facilitates any waste recycling/disposal operations.

Advantageously, if the operation of the plant 1 is interrupted for a format change (size and/or geometric), it is possible to do a quick set-up change along the production line L. Advantageously, in fact, it is possible, according to this invention, to replace multiple punch blocks together, which are grouped according to a preferred form of implementation. In this case, the combination of the different punches that can be used along the production line can be prepared in masked time during the operation of the plant 1 and limit the rest period to the period of replacing the punch block alone.

Advantageously, the method of the type described above allows a fastener F to be obtained by deforming the raw material M alone, completely eliminating the mechanical machining for removal. This guarantees a higher metallurgical performance than traditional methods, because the plastic deformation created in a fastener F is totally uniform, essentially creating continuous uniform lines of fibres (and pre-tensioning) in the matrix of the material. This is different to what happens in a fastener produced by removing chips, according to known methods, where the structure of the metal matrix is weakened and has points of discontinuity localized (for example in areas where the mechanical machining was performed by removal).

Therefore, the manufacturing method according to this invention allows fasteners F that are qualitatively better compared to similar fasteners produced according to traditional methods, to be obtained.

The method and the plant 1 of the type described above, operating only by plastic deformation advantageously makes the machining waste totally negligible, reducing the cost of recycling the waste material.

The plant 1 of the type described above advantageously allows a plurality of fasteners F that are different in terms of size and/or geometry, depending on the intermediate finishing stations SM that are activated during the plastic deformation step, to be manufactured with a single production line L. In this way, it is advantageously possible to produce batches of fasteners F with a single production line L without having to interrupt production if, for example, the raw material M (in the form of a coil or bar) being fed is finished but the machining format does not change; or to have extremely reduced set-up pauses if the punch block has to be replaced to change the format of the fastener F type. This is in particular advantageous if it is necessary to dispatch orders that have batches with different fasteners F, as can happen, for example, in the aerospace sector.

In addition, this production line L allows batches to be completed in a short time (it is possible to produce more than 100 fasteners F per minute, approximately), thus allowing delivery times for customers to be sped up. This is in particular advantageous, as it allows its customers to reduce the stock in storage by significantly reducing the waiting time for the supply compared to traditional production methods.

The invention claimed is:

1. A method for manufacturing fasteners along a production line of a plant; the production comprising a plurality of stations; the method comprising the following steps:

at a feeding station, feeding raw material having a tensile strength equal to or greater than 800 MPa;

at a heating station, heating the raw material to a predefined temperature so as to obtain hot raw material; wherein, the temperature reached is not such as to allow the formation of a surface layer of oxide on the hot raw material;

at a cutting station, cutting the hot raw material so as to separate one or more pieces of a predefined length, in succession, by means of a die/punch system that is configured to continuously cut and feed each piece to a successive finishing station;

at one or more finishing stations plastically deforming each piece by means of one or more finishing stations, so as to obtain a fastener;

wherein said material is automatically advanced along the production line, by means of advancement means, during the feeding, heating, cutting and deforming steps;

the plant comprising a centralised control system which is connected to each of said stations, so that each of said station can be regulated in real time, according to a type of fasteners to be produced or to data detected in real time along the production line by means of sensors; wherein said steps are carried out simultaneously by the plant, so as to obtain a continuous and automatic production of fasteners that are the same or different in terms of geometry and/or size.

2. The method according to claim 1, and comprising, along the production line downstream of the deforming step, with respect a forward direction:

a quality control step, wherein a fastener is subjected to size, geometry, and/or qualitative checks.

3. The method according to claim 1, wherein the plastically deforming step comprises the plastic deformation of said one or more pieces by means of one or more successive deformation sub-steps, each of which is carried out at a respective intermediate finishing station of said production line, so as to obtain a respective semi-finished product at each intermediate finishing station.

4. The method according to claim 1, wherein the plastic deformation step comprises a sub-step of producing one or more threads on a semi-finished product at a threading station.

5. The method according to claim 4 and comprising the step of heat treating a semi-finished product before the sub-step of producing one or more threads; wherein the heat treating step is performed at a heat treatment station located upstream of the threading station, with respect to the forward direction along the production line.

6. The method according to claim 1, wherein the step of heating the raw material is performed using an induction heating device.

7. The method according to claim 1, wherein the step of feeding the raw material involves a sub-step of coating said raw material with a coating layer; wherein the sub-step of coating occurs prior to the heating step.

8. The method according to claim 1, wherein said control system can activate or deactivate each step depending on a type of fastener to be produced; the method being characterised in that it can automatically produce fasteners that are different in terms of size and/or geometry and/or surface finish, depending on the steps activated or deactivated by means of said control system.

9. The method according to claim 1, wherein the step of feeding the raw material involves feeding cylindrical material made of material having a tensile strength equal to or greater than 1100 MPa.

10. A plant for manufacturing fasteners and comprising a production line along which are located:

a feeding station for raw material;

a heating station configured to heat the raw material up to a predefined temperature so as to obtain hot raw material; wherein, the temperature reached is not such as to allow the formation of a surface layer of oxide on the raw material;

a cutting station comprising a die/punch system that is configured to continuously cut the hot raw material so as to separate one or more pieces of a predefined length, in succession and feed each piece to a successive intermediate finishing station;

one or more finishing stations, each of which is configured to plastically deform each piece so as to obtain a fastener;

heating means configured to heat the raw material at said heating station to said predefined temperature;

advancement means that automatically transport the material along the production line;

a control system which is connected to each of said stations, so that each of said station can be regulated in real time, according to a type of fastener to be produced or to data detected in real time along the production line by means of sensors.

11. The plant according to claim 10, and comprising, along the production line:

a quality control station configured to perform geometry and/or size and/or quality checks on the fastener.

12. The plant according to claim 10, and comprising downstream of the cutting station a plurality of intermediate finishing stations, located in succession along the production line, each intermediate finishing station is configured to deform said piece or a semi-finished product so as to obtain a respective, predefined semi-finished product; and a threading station configured to produce one or more threads on a semi-finished product at the outlet of said intermediate finishing stations.

13. The plant according to claim 12 and comprising a heat treatment station located upstream of the threading station, with respect to a forward direction along the production line.

14. The plant according to claim 10, wherein the heating means comprises an induction heater configured to heat the raw material to the predefined temperature.

15. The plant according to claim 10 and comprising a coating station located upstream of the heating station, with respect to a forward direction along the production line; wherein said coating station is configured to apply coating material to said raw material.

16. The plant according to claim 10, wherein the control system is configured to selectively activate or deactivate each intermediate finishing station and/or the threading station, so as to manufacture different fasteners depending on the workstations activated during the plastic deformation step.

* * * * *